US007442895B2

(12) United States Patent
Bauer et al.

(10) Patent No.: US 7,442,895 B2
(45) Date of Patent: Oct. 28, 2008

(54) ELECTRIC SWITCH

(75) Inventors: Guenter Bauer, Sulzbach-Rosenberg (DE); Eduard Ruff, Auerbach (DE)

(73) Assignee: Cherry GmbH, Auerbach/OPF (DE)

( * ) Notice: Subject to any disclaimer, the term of this patent is extended or adjusted under 35 U.S.C. 154(b) by 23 days.

(21) Appl. No.: 11/485,841

(22) Filed: Jul. 12, 2006

(65) Prior Publication Data

US 2007/0062796 A1 Mar. 22, 2007

(30) Foreign Application Priority Data

Sep. 16, 2005 (EP) ..... 05020267

(51) Int. Cl.
*H01H 13/12* (2006.01)

(52) U.S. Cl. ..... 200/531; 200/532; 200/536

(58) Field of Classification Search ..... 200/531
See application file for complete search history.

(56) References Cited

U.S. PATENT DOCUMENTS 3,786,209 A 1/1974 Bury
5,075,516 A * 12/1991 Brouillette ..... 200/5 R
5,369,238 A * 11/1994 Hirata ..... 200/530
5,463,198 A 10/1995 Shimaoka
5,568,860 A * 10/1996 Stringwell et al. ..... 200/242
6,791,038 B1 * 9/2004 Lai ..... 200/16 A

FOREIGN PATENT DOCUMENTS

| | | |
|---|---|---|
| DE | 4420665 | 12/1994 |
| EP | 1088616 | 10/1967 |
| EP | 1288985 | 3/2003 |
| EP | 1533823 | 5/2005 |

* cited by examiner

*Primary Examiner*—Elvin Enad
*Assistant Examiner*—Lheiren Mae A Anglo
(74) *Attorney, Agent, or Firm*—Jordan and Hamburg LLP

(57) ABSTRACT

An electrical switch has a common contact body and a first selective contact body and a second selective contact body. A contactor is connected mechanically and in an electrically conducting manner to the common contact body. The contactor comprises an elastic, electrically conducting material. It is formed originating from the basic form of a leaf spring into a multifunctional part having a clamping area, a deformation area and a stiffened actuating area. The pre-tension of the contactor causes the contact fingers to be positioned against the contact surfaces of the first selective contact body. Pressure on the actuating area elastically deforms the contactor, and the actuating area pivots with the contact fingers so that the contact fingers switchingly enclose the contact surfaces of the second selective contact body.

19 Claims, 5 Drawing Sheets

ELECTRIC SWITCH

BACKGROUND OF THE INVENTION

The invention relates to an electrical switch in which a common contact body and a first selective contact body and a second selective contact body are provided in a housing. A movable contactor that can be moved outside of the housing against spring force produces the electrically conducting connection between the common contact body and either the first or the second selective contact body. A switch of this type is known for instance from DE 44 20 665 B4.

In this known switch, the contact surfaces of the first selective contact body and of the second selective contact body are set in a wall of the switch housing. The contactor is a sliding body that is provided with an actuating member that projects from the housing. Added to the sliding body is a contact plate that has a projecting contact finger. The contactor is pressed into its final position by a compression spring in the form of a helical spring. The helical spring produces the electrically conducting connection between the contact finger and the common contact body set in the housing. In the first final position, effected by the helical spring, the contact finger located on the contactor is positioned against the contact surface of the first selective contact body. When there is pressure on the actuating member, the contactor is displaced against the restoring force of the helical spring into its second final position in which the contact finger is positioned against the contact surface of the second selective contact body.

Switches of this type are embodied in the fields of miniaturization and subminiaturization and perform switching tasks in which a normally closed electrical contact is temporarily interrupted by the mechanical effect on the actuating member and the conducting connection is produced on a normally closed second contact.

Switches of this type are particularly suitable for position detection tasks in automatic production processes. However, typical areas of application can also be lock systems in vehicle bodies and interior areas of a motor vehicle as well as various position queries in household devices or other mechanisms.

Given that in the known switch in accordance with DE 44 20 665 B4 the contact finger of the contactor slidingly alternates from contacting the first contact surface to contacting the second contact surface, what is achieved is that the switching behavior can be intentionally influenced. The influencing variables are primarily the slide path of the contact finger, the size of the contact surfaces, and their distance from one another. These variables can be optimized with respect to one another. For instance, it is possible to maintain a strict separation between both switching positions, or to prevent an intermediate position in which both contact surfaces are in conducting contact with the contact finger. Furthermore, what a switch of this type achieves is that the switching process reliably occurs at a desired point in time regardless by whether the actuation from outside occurs rapidly or slowly.

In the known switch in accordance with DE 44 20 665 B4, it is disadvantageous that the current-conducting connection requires a plurality of components starting from the fixed common contact body via the helical spring and the contact plate up to the contact finger and in addition requires the sliding body of the contactor for holding or positioning these components. Moreover, a narrow side of the plate-like body of the contactor must be guided very precisely along the flat housing wall in which the contact surfaces of the first and second selective contact bodies are set. The contactor must not jam or become canted. This requires extremely precise manufacture of the individual parts and complex assembly if reliable functioning is to be assured over extended periods of time.

Known from EP 1 533 823 A1 is another switch in which a common contact body is selectively connected to a first or a second selective contact body using a contactor. In this case, the contactor is an elastically deformable leaf spring that receives from a tongue formed by it a pre-tension in the longitudinal direction and that is therefore urged to assume a curved shape. With the entire width of its free end the leaf-shaped contactor engages in the intermediate space of correspondingly formed areas of the selective contact body. The surfaces of these areas run parallel to the surface of the leaf-shaped contactor. The electrically conducting connection between the contactor and one of the two selective contact bodies can be produced using additional small contact bodies that are disposed at the free end of the leaf-shaped contactor and at the aforesaid areas of the first and second selective contact bodies. The surface of the leaf-shaped contactor and the surfaces of the aforesaid areas on the selective contactors run parallel to one another. The switching state is changed in that an actuating member acts on the opposing free end of the leaf-shaped contactor. The actuating member is acted upon by a compression spring, exerting a tensile force on the end of the leaf spring opposing the switching area. The leaf-shaped contactor obtains an extended shape from the tensile force. When the actuating member is depressed, the leaf-shaped contactor relaxes under the effect of its internal tension, transitions to its curved shape, and thus moves into the opposing switching position in which it is connected, electrically conducting, to the second selective contact body. The switch in accordance with EP 1 533 823 A1 is thus a so-called "sensitive switch" that has other switching properties than the earlier aforesaid switch in accordance with DE 44 20 665 B4. Above all it is not possible to precisely adjust the switching function with the switch in accordance with EP 1 533 823 A1 as it was described in the foregoing. In addition, the aforesaid special switching bodies must be placed on the switching free end of the elastically deformable contactor in accordance with EP 1 533 823 A1, likewise on the surfaces of the opposing areas of first and second selective contactor, which surfaces cooperate therewith; otherwise it is not possible to produce a reliable electrical contact.

The underlying object of the invention is therefore to create an electrical switch in which during a switching procedure the switching behavior can be precisely adjusted regardless of the type of operation and which also enables an intermediate position with contact to both selective contact bodies and which still enables reliable operation over extended periods of time with a simple structure, simple production, and simple assembly.

SUMMARY OF THE INVENTION

In the inventive electrical switch, an elastically deformable contactor is provided in the basic form of a leaf spring. The deformation state of this contactor is altered by the effect of an actuating member. The contactor is provided with contact fingers that project from the plane of the leaf spring and that can slidingly cover contact surfaces that are embodied on the first and second selective contact bodies. The sliding covering of the contact surfaces by the contact fingers like a type of sliding contact effects self-cleaning of the contact surfaces. This is important if the switch must be operated under unfavorable environmental conditions and for instance oxide layers, silicate layers, or other undesired deposits can occur on the contact surfaces. Foreign layers that disturb functionality can frequently be removed mechanically. Sliding contacts can remove even foreign particles or wear particles from plastic parts from the common surface for contact fingers and contact surfaces. In principle no discrete restoring spring is required for the actuating member.

The elastically deformable contactor formed from the basic form of a leaf spring can be produced economically as a simple punch part with bent elements and is nevertheless a multifunction part that combines the function of a movable switching part, an electrically conducting contact, and a restoring spring.

A second aspect of the invention relates to the functional division of the contactor, on which is provided one after the other a fastening area, a central deformation area, and an adjacent stiffened actuating area from which the contact fingers originate. The contactor can have a step-like shape, a U-shape, or an angular shape. What is intended with a step-like shape is that the fastening area and the actuating area are in two different planes—similar to a Z shape—and are joined to one another by the deformation area that is disposed therebetween and that extends approximately perpendicular thereto. In a contactor that has a U-shape, the fastening area and actuating area are likewise in different planes; however they face one another, whereby the leg of the U forms the deformation area. For the angular shape, the apex area of the angle replaces the leg in the U-shape. The configuration thus described requires the contactor to be a multifunctional part.

The embodiment in accordance with the second aspect of the invention is associated with the additional advantage that the extension of the fastening area, deformation area, and actuating area can be distributed differently over the length of the contactor. In the design of the switch, a different translation ratio can be selected and set between the movement of the actuating member and the switching paths of the contact fingers. This means another variation option for the switching behavior. In contrast, in the aforesaid switch in accordance with DE 44 20 665 B4, the actuating member and the contactor are joined to the contact plate in an unchangeable common linear movement. The movement of the actuating member and the contact finger is thus rigidly established at a ratio of 1 to 1.

For the great majority of tasks, the internal tension or pre-tension of the contactor is adequate to effect the required return into the preferred switching position. When necessary, however, in accordance with a third aspect of the invention a reinforcing compression spring can also be added.

A fourth aspect of the invention provides options for stiffening the actuating area, while a fifth aspect of the invention is a particularly advantageous option for placing the contact fingers against the actuating area.

Sixth and seventh aspects of the invention include an advantageous embodiment of the contactor and the selective contact bodies as they are used in particular in a contactor having a step-shape.

Eighth and ninth aspects of the invention provide advantageous configuration options that are based on the embodiment of the contactor in a U-shape.

Tenth and eleventh aspects of the invention are modified embodiments based on the design of the contactor in an angular shape.

In specific configurations of contactors according to the invention, a pivoting movement for the actuating member generally occurs because the deformation area of the leaf spring is relatively precisely localized.

It should furthermore be stressed that in all of the embodiment types the contact fingers bent out from the contactor move with their wide side onto the contact surfaces of the two selective contact bodies. Even if the ends of the contact fingers that act as sliding contacts are embodied angled or curved in the conventional manner, there is a narrow contact surface, the wide side of which moves over the contact surfaces of the selective contact bodies. This is a clear difference from the prior art in accordance with DE 44 20 665 B4 and supports assured switching behavior as well as self-cleaning of the switch. Likewise, in contrast to the prior art, the arrangement of the contact fingers in pairs substantially strengthens switch reliability due to their redundancy.

The invention shall now be explained in greater detail using exemplary embodiments that are illustrated in the figures. The figures depict the following:

DETAILED DESCRIPTION OF THE INVENTION

Figure 1:
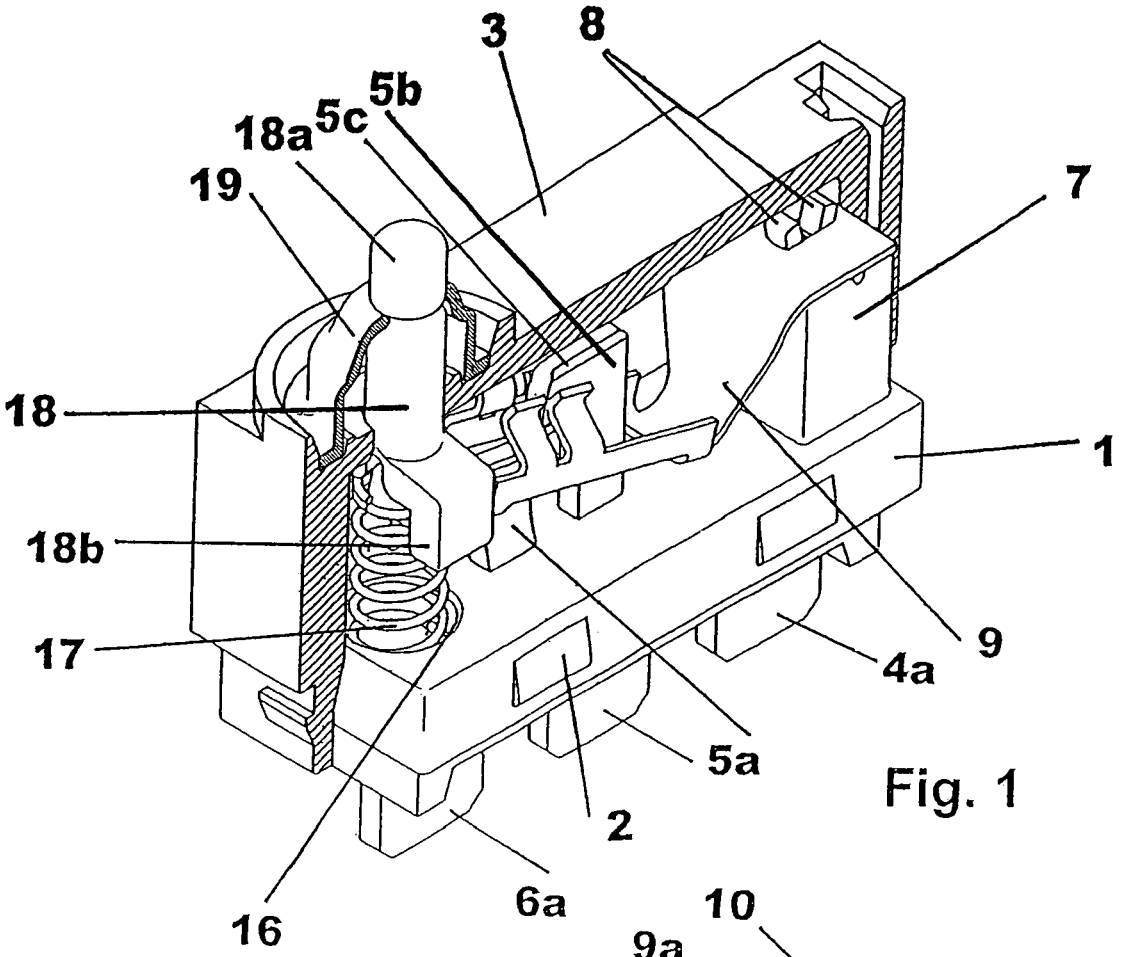
FIG. 1 is a perspective, partially cut-away view of a first embodiment of the inventive electrical switch.

FIGS. 1 through 4 depict a first embodiment of the electrical switch in accordance with the invention. The switch has a housing comprising a base 1 that has fastening projections 2 for fastening a cover 3. Set in the insulating material of the base 1 are three contact bodies, specifically a common contact body 4, a first selective contact body 5, and a second selective contact body 6. The contact bodies 4, 5, and 6 have a flat plate-like configuration and have different contours (see FIGS. 3 and 4).

A connector contact 4*a* is embodied at the bottom of the common contact body 4, likewise a connector contact 5*a* is embodied at the bottom of the first selective contact body 5 and a connector contact 6*a* is embodied at the bottom of the second selective contact body 6. The function of the switch is to connect in an electrically conducting manner either to the connector contact 5*a* or to the connector contact 6*a* depending on the switching position of the connector contact 4*a*.

A contactor 9 made of an electrically conducting, elastically deformable material is used for this. The basic form of the contactor 9 is that of a leaf spring that is bent into somewhat of a Z-shape (see FIG. 2). For fastening it to the base 1, a seat 7 is formed on the latter and the common contact body 4 runs therethrough and forms on the top side of the leaf spring a flat positioning surface for a flat fastening area 9*a* of the contactor 9. The top of the common contact body 4 terminates in spreading elements 8 that project from the flat positioning surface of the seat 7 and pass through a fastening opening 10 in the flat fastening area 9*a* of the contactor 9. In this manner the contactor 9 is securely fastened to the base 7 and at the same time is connected in an electrically conducting manner to the connector contact 4*a* of the common contact body 4.

Figure 2:
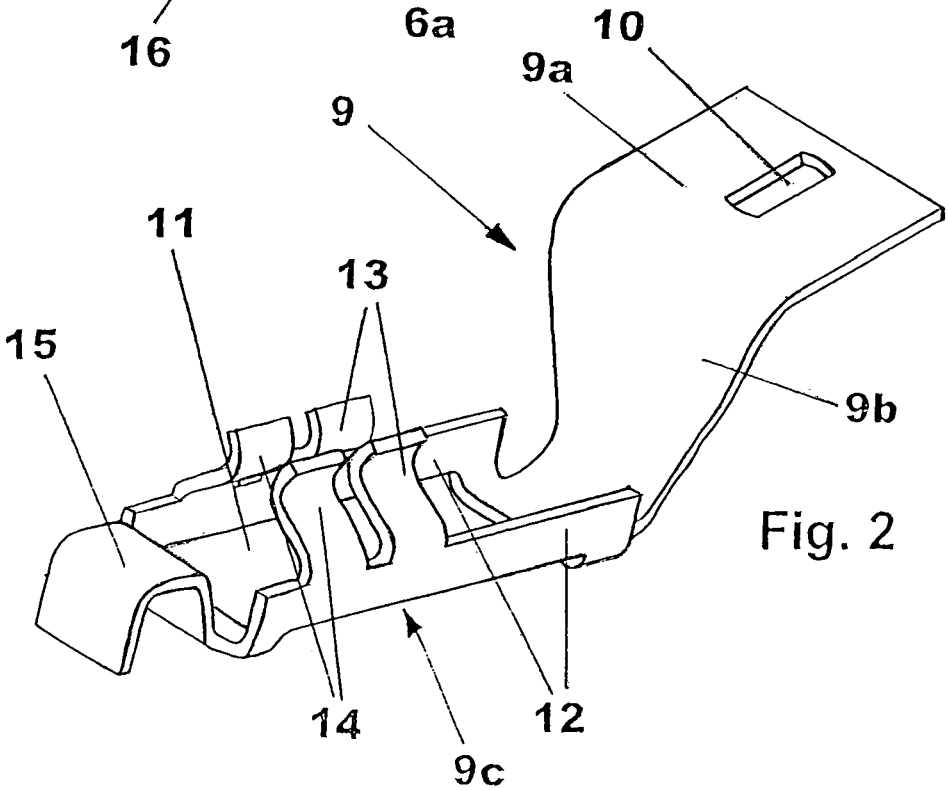
FIG. 2 depicts the contactor associated with this embodiment in a perspective view.

FIG. 2 depicts the details of the contactor 9 with particular clarity. Opposing its fastening area 9*a*, the leaf spring that forms the basic shape of the contactor 9 has a stiffened area that is created by a large center opening 11 and two upwardly bent edge strips 12 that enclose the center opening 11 in the longitudinal direction. Embodied on the front narrow side of the contactor 9 in FIG. 2 is a slide-and-grab latch 15, the importance of which will the explained in the following. As can be seen, the edge strips 12 together with the slide-and-grab latch 15 form a stiff frame that essentially cannot be elastically deformed and that acts as an actuating area 9*c* for the contactor. Instead, the center part of the Z shape, which joins the fastening area 9*a* to the actuating area 9*c*, acts as the deformation area 9*b* for the contactor 9. When a displacing force acts on the slide-and-grab latch 15 perpendicular to the plane of the leaf spring, the deformation area 9*b* deforms and the actuating area 9*c* moves in a pivoting movement similar to the spoke of a wheel.

A first pair of contact fingers 13 and a second pair of contact fingers 14 are formed on the edge strips 12 of the contactor 9. The contact fingers 13 of the first pair oppose one another, as do the contact fingers 14 of the second pair. The contact fingers 13 and 14 are bent inward from the plane of the edge strips 12 and have an offset shape so that they can bend outward resiliently.

The distance between the contact fingers 13 and 14 that are arranged in pairs is dimensioned such that they can wrap around the flat, plate-like first and second selective contact bodies 5 and 6 and surround them from both sides. With the apex areas of their offset sections, the contact fingers 13 and 14 are resiliently positioned against contact surfaces 5*b* and 6*b* of the selective contact bodies 5 and 6.

Figure 3:
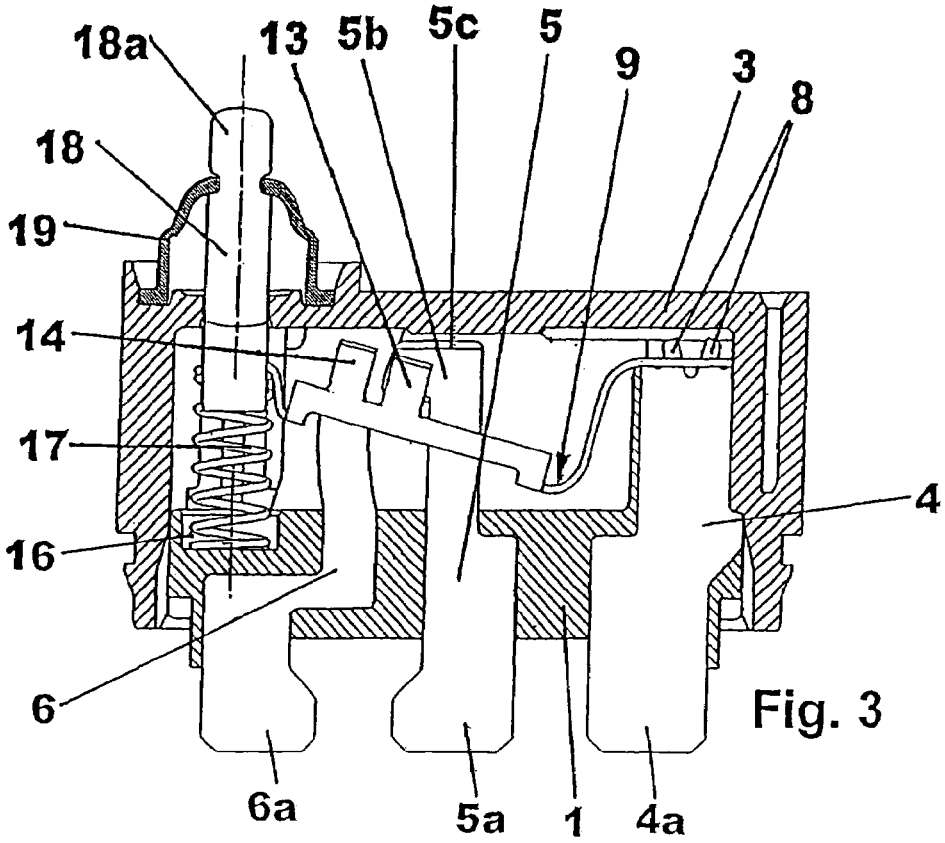
FIG. 3 depicts a longitudinal section through the switch in accordance with FIG. 1 in a first switching position.
Figure 4:
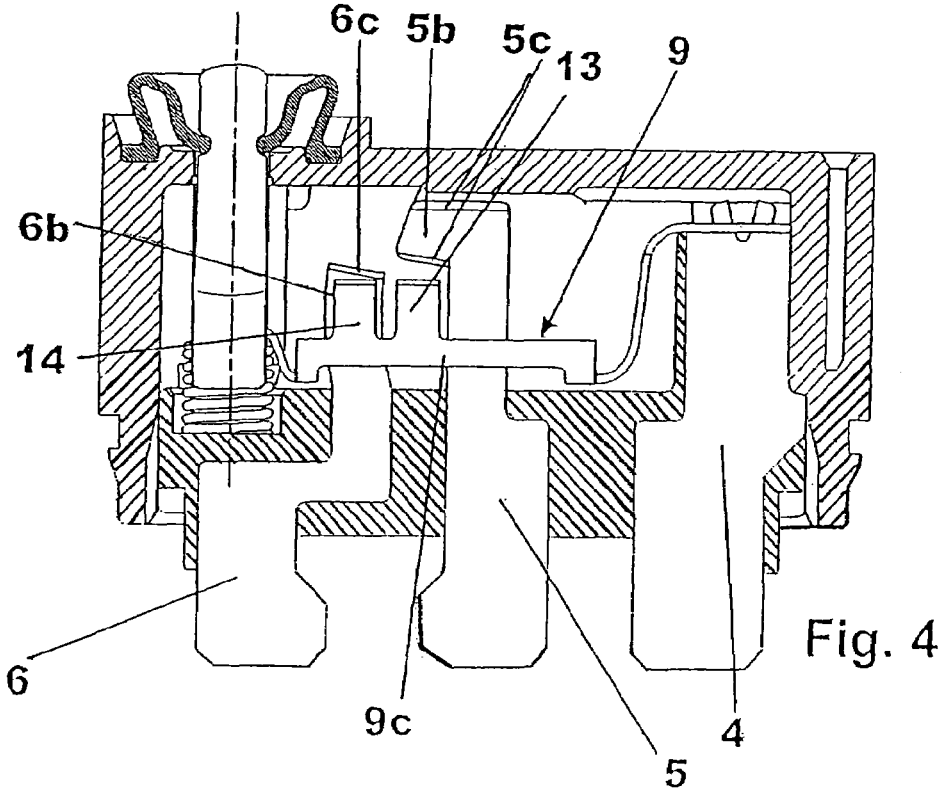
FIG. 4 is a longitudinal section corresponding to FIG. 3 in the second switching position of the switch in accordance with FIG. 1.
Figure 5:
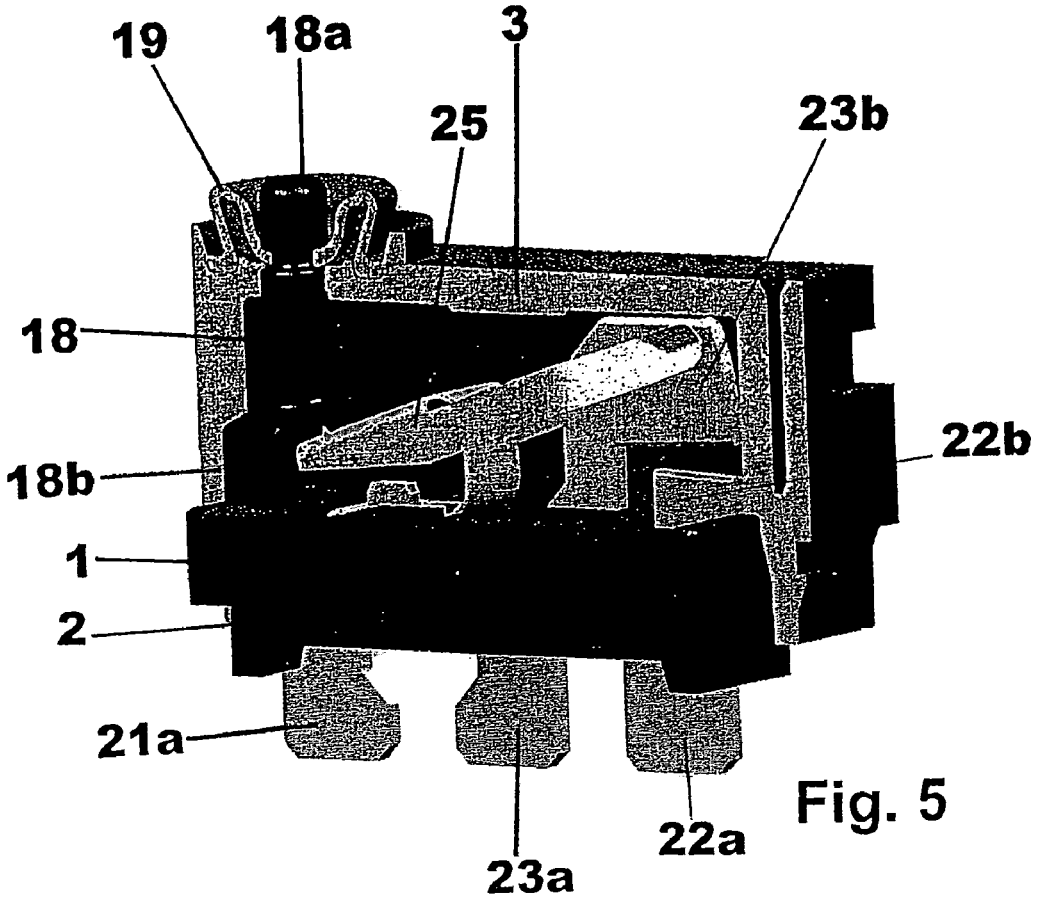
FIG. 5 is a perspective, partially cut-away view of a second embodiment of the inventive switch.
Figure 6:
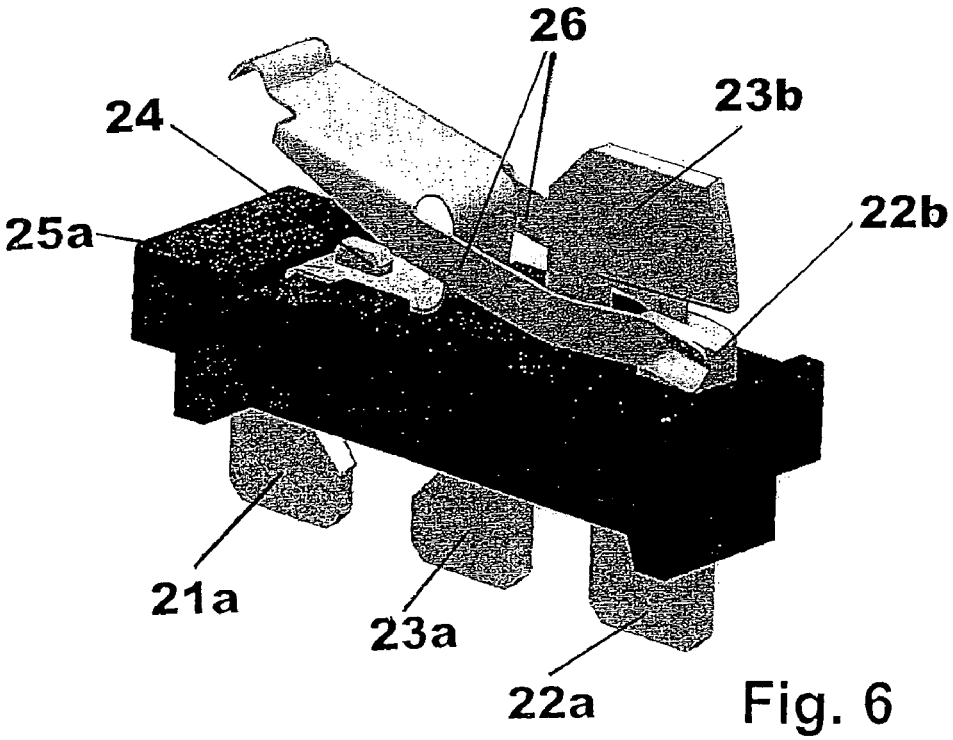
FIG. 6 is a depiction of the same switch, corresponding to FIG. 5, whereby however individual parts have been omitted and the switching state has been changed relative to FIG. 5.
Figure 7:
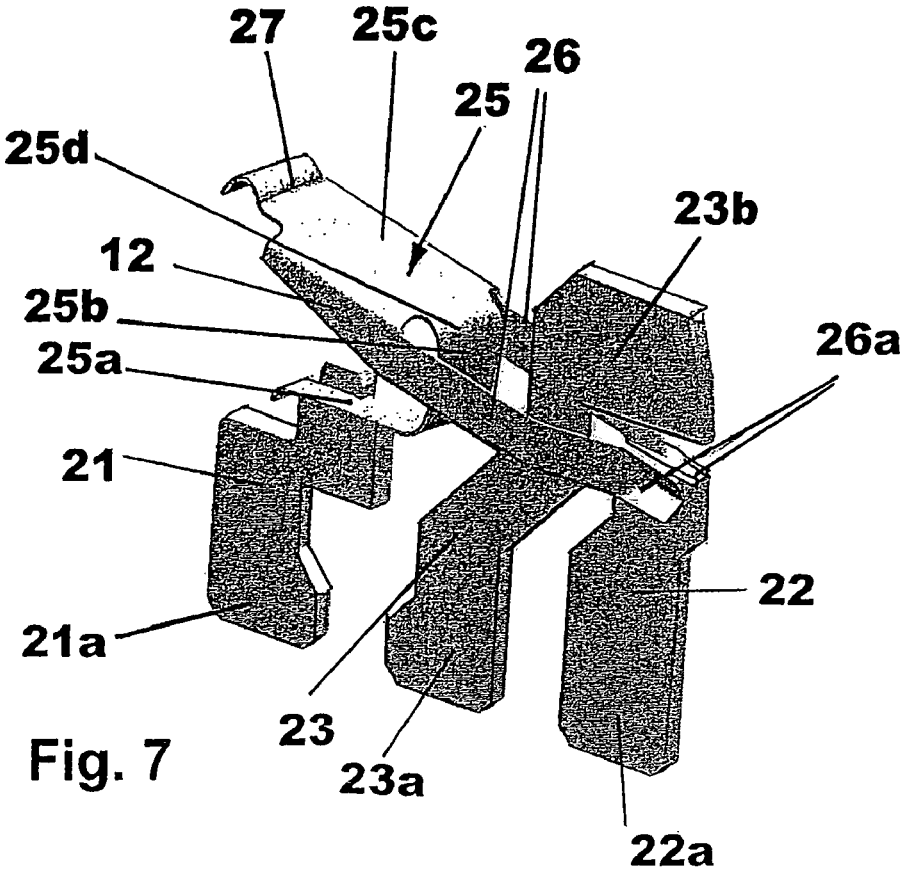
FIG. 7 is a perspective depiction to explain the cooperation of functional parts of the switch in accordance with FIGS. 5 and 6.

The precise allocation of the contact fingers 13 and 14 to the contact surfaces 5*b* and 6*b* in accordance with the construction of the switch can be seen in FIGS. 3 and 4. In FIG. 3, the contactor 9 is in its first switching position, which is created by the internal tension or pre-tension of its deformation area 9*b*. The contact fingers 13 of the first pair are positioned against the contact surfaces 5*b* of the first selective contact body 5 and with their offsets form resiliently elastic sliding contacts. They also maintain an electrically conducting connection with the contact surfaces 5*b* when they move onto the contact surfaces with a pivoting movement of the actuating area 9*c*. The contact fingers 14 of the second pair have no effect on the first switching position of the contactor 9.

In the depiction in FIG. 4, the contactor 9 is in its second switching position. The actuating area 9*c* of the contactor 9 is now approximately horizontal at the bottom in the vicinity of the base 1, and the contact fingers of the first pair 13 now have no effect. The contact fingers 14 of the second pair now wrap around the flat, plate-like second selective contact body 6 and are positioned as sliding contacts against its contact surfaces 6*b*.

Thus in the first switching position (FIG. 3), the connector contact 4*a* of the common contact body 4 is connected in an electrically conducting manner to the connector contact 5*a* of the first selective contact body 5. On the other hand, in the second switching position (FIG. 4) there is an electrically conducting connection between the connector contact 4*a* of the common contact body 4 and the connector contact 6*a* of the second selective contact body 6.

The actuating member 18 is used to transition the contactor 9 from its first switching position to its second switching position. Its control head 18*a* projects outward through the cover 3 of the switch, whereby the through-opening located in the cover 3 is sealed by a sealing collar 19. The actuating member 18 terminates fork-like in two arms 18*b* that form a pressure surface 18*c* and that wrap around the slide-and-grab latch 15 of the contactor 9 (see FIG. 1 and the identical embodiment of the holding member 18 in accordance with the top right of FIG. 9).

Downward pressure on the actuating member 18 overcomes the internal tension or pre-tension of the contactor 9. The latter is elastically deformed and its actuating area 9*c* transitions downward into the second switching position in accordance with FIG. 4. In many cases, the elastic restoring force of the contactor 9 is sufficient for attaining clear switching behavior. However, when needed the switching and restoring force can also be increased by the arrangement of an additional compression spring 17. In the exemplary embodiment depicted, it is embodied as a helical spring that is seated in a positioning depression 16 on the bottom of the base 1. At its opposing end, the slide-and-grab latch 15 engages in the interior of the compression spring 17. At the same time, the compression spring 17 is also held from the outside by the arms 18*b* of the actuating member 18. In order for the two pairs of contact fingers 13, 14 to be able more easily to enclose the contact surfaces 5*b*, 6*b* of the first and second selective contact bodies 5, 6, the two selective contact bodies 5, 6 are provided with leading angles 5*c*, 6*c* at their narrow sides located in the path of the contact fingers 13, 14.

The contactor 9 comprising an elastic and electrically conducting material is a multifunction part that can both provide the contact via the contact fingers 13, 14 and also return the actuating member 18 to the first switching position. In practice, the switch is used in the field of sub-miniaturization; the control head 18*a* of its actuating member 18 is for instance actuated by a moving cam in a mechanical or hydraulic control device.

The subject of FIGS. 5 through 8 is a second embodiment of the inventive switch. In these figures, the parts that are the same as in the first exemplary embodiment retain the same reference numbers. Primarily what has changed is the shape of the contactor 25, which also involves a modified shape of the contact body. In the second embodiment of the contactor 25, the leaf spring starts out bent in a U-shape so that the fastening area 25*a* and the flat actuating area 25*c* are disposed above one another; they are also joined to one another by a deformation area 25*b*. Running extended linearly from the fastening area 25*a* are two contact fingers 26 that are bent out of the plane of the leaf spring and that project therefrom. The contactor 25 thus has only a single pair of contact fingers 26; this design results in a shortened structural length.

Figure 8:
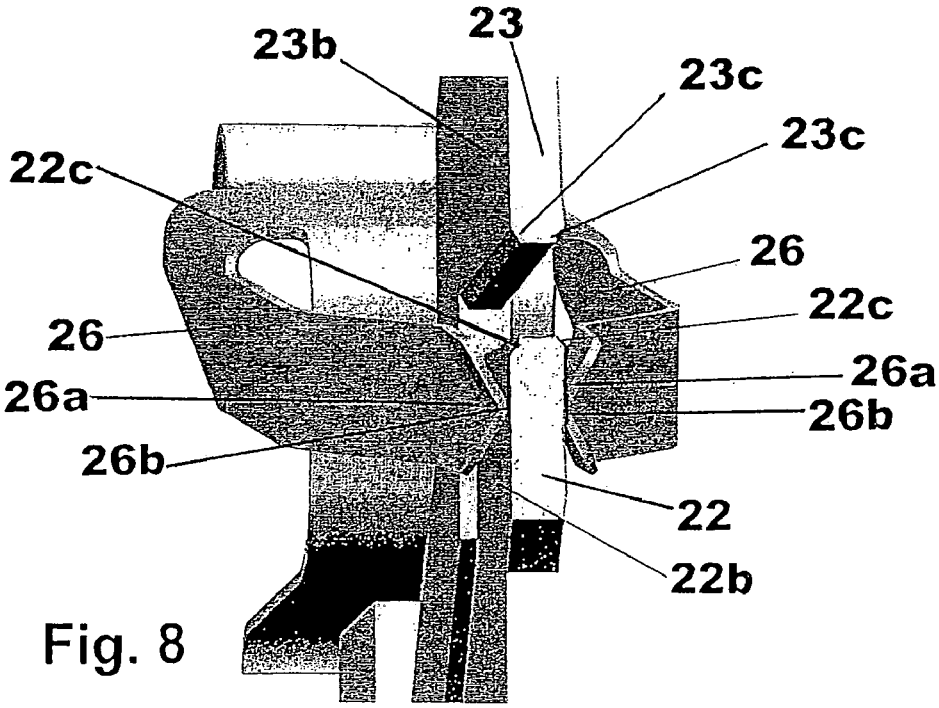
FIG. 8 provides a detail from FIG. 7 in an enlarged and modified perspective depiction.

Otherwise, the configuration in accordance with the first embodiment is retained for the most part. Like the first selective contact body 22 and the second selective contact body 23, the common contact body 21 has a flat, plate-like configuration along with connector contacts 21*a*, 22*a*, and 23*a*. The contact areas 26*a* of the contact fingers 26 are drawn in offset inwardly to the width of the two selective contact bodies 22, 23 and are bent cross-sectionally in a V-shape, whereby the interior apex lines 26*b* of the V-shape form sliding contacts that resiliently cover the contact surfaces 22*b*, 23*b* of the first and second selective contact bodies 22, 23 (FIG. 8). Leading angles 22*c*, 23*c* facilitate the enclosing of a selective contact body 22, 23 using the contact fingers 26 in this case as well.

For cooperating with the actuating member 18, at its end opposing the contact fingers 26 the contactor 26 has a sliding curvature 27 that forms the end of the actuating area 25*c*. The common contact body 21 terminates at the top in a rivet-like fastening head 24 that passes through an opening in the fastening area 25*a* of the contactor 25 and thereby fastens the latter mechanically and in an electrically conducting manner.

Figure 9:
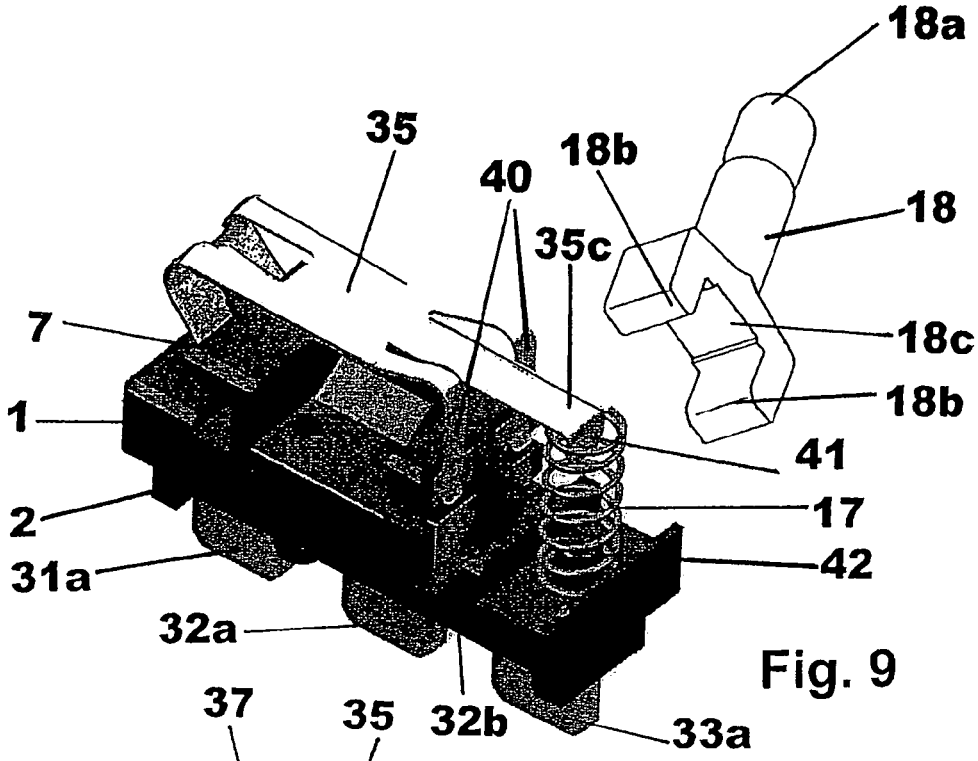
FIG. 9 provides the perspective depiction of a third embodiment of the inventive electrical switch, whereby the cover of the housing has been omitted.
Figure 10:
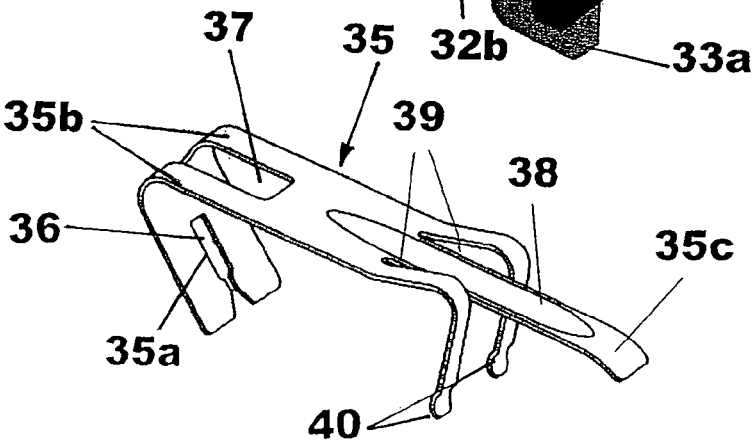
FIG. 10 depicts the contactor associated with the switch in accordance with FIG. 9 in a slightly modified embodiment.
Figure 11:
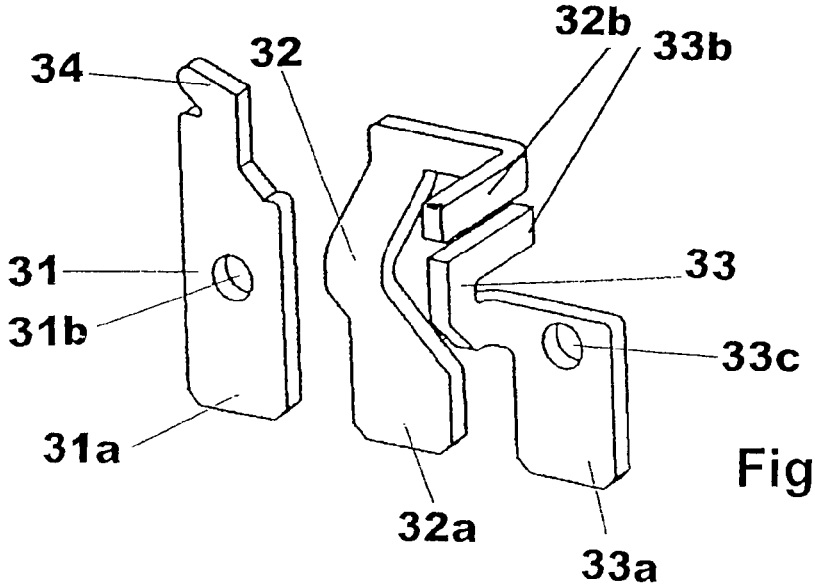
FIG. 11 depicts the principle that dictates the perspective arrangement of the contact bodies in the switch in the third embodiment.

FIGS. 9 through 11 depict a third embodiment of the inventive the electrical switch. Essential parts thereof have already been described using FIGS. 1 through 4 and are labeled with the same reference numbers. In this case, as well, there is a common contact body 31 having a connector contact 31*a* as well as first and second selective contact bodies 32, 33 with connector contacts 32*a* and 33*a*. Anchoring apertures are labeled 31*b* and 33*c*, and these are used to fasten the common contact body 31 and the second contact body 33 to the insulating material of the base 1. In contrast to the exemplary embodiments already described, the first and second contact bodies 32 and 33 no longer retain the continuous flat, plate-like shape. On the contrary, the areas of the two selective contact bodies 32, 33 that form the contact surfaces 32*b* and 33*b* are bent outward approximately 90° out of the basic flat shape of the selective contact body; thus they run transverse to the longitudinal orientation of the contactor 35.

The latter again has the basic or initial shape of a flat leaf spring that extends in its longitudinal direction across all three contact bodies 31, 32, and 33. The fastening area 35*a* of the contactor 35 is curved downward and back out of the starting plane until it runs at an acute angle to the rest of the contactor 35 (FIG. 1). A fastening slot 36 permits placement on a fastening projection 34 that is embodied on the common contact body 31. The curved area in the bend becomes the deformation area 35*b*; this function is particularly supported by a center recess 37 in this area.

The remaining area of the leaf spring forming the contactor 35 is divided by two longitudinal recesses 39 that run in its longitudinal direction and that project into the center area of the contactor 35 starting from the free end of the contactor 35 that opposes the fastening area 35*a*. The longitudinal recesses 39 separate a center bar from two contact fingers 40 that are bent at an angle out of the plane of the leaf spring in the same manner as a fastening area 35*a* and that form sliding contacts with their resilient ends. In contrast, the center bar is stiffened with a reinforcing bead or rib 38 and remains largely in the original plane of the leaf spring. It thus forms the actuating area 35*c* of the contactor. If the additional compression spring 17, cited in the foregoing, is to be used, the free end of the actuating area 35*c* is provided with an engaging end 41 that engages in the compression spring 17 (FIG. 9). At its lower end, the compression spring is placed on a mounting base 42.

In those cases in which the holding and restoring force of the contactor 35 is adequate for proper switch functioning, it is preferred that the free end of the actuating area of 35*c* is designed with a slight curvature.

When assembled, the contactor 35 receives a longitudinal tension because with its fastening end 35*a* on its one side and with the resilient contact fingers 40 on its other side it wraps around a center area of the base 1. This results in adequate pressure for the resilient ends of the contact fingers 40 acting as sliding contacts. In the embodiment in accordance with FIGS. 9 through 11, the contact surfaces 32*b* and 33*b* are present only on one side of the first and second selective contact bodies 32 and 33. Those areas of the selective contact bodies 32 and 33 at which the contact surfaces 32*b* and 33*b* are located are securely supported on their back sides in the base 1. The pre-tension of the contactor 35 attained using the deformation area 35*b* effects the first switching position of the switch in which the two contact fingers 40 are in switching contact with the contact surface 32*b* of the first selective contact body 32*b* running transverse to the longitudinal direction of the contactor 35. Depressing the actuating member 18 overcomes the pre-tension of the contactor 35 and initiates the second switching position in which the contact fingers 40 are positioned against the contact surface 33*b* of the second selective body 33.

| Legend | |
|---|---|
| FIGS. 1 through 4: | |
| 1 | Base |
| 2 | Fastening projection |
| 3 | Cover |
| 4 | Common contact body |
| 4a | Connector contact |
| 5 | First selective contact body |
| 5a | Connector contact |
| 5b | Contact surface |
| 5c | Leading angle |
| 6 | Second selective contact body |
| 6a | Connector contact |
| 6b | Contact surface |
| 6c | Leading angle |
| 7 | Seat |
| 8 | Spreading elements |
| 9 | Contactor (leaf spring) |
| 9a | Fastening area |
| 9b | Deformation area |
| 9c | Actuating area |
| 10 | Fastening opening |
| 11 | Center recess |
| 12 | Edge strip |
| 13 | First pair of contact fingers |
| 14 | Second pair of contact fingers |
| 15 | Slide-and-grab latch |
| 16 | Positioning depression |
| 17 | Compression spring |
| 18 | Actuating member |
| 18a | Control head |
| 18b | Arm |
| 18c | Pressure surface |
| 19 | Sealing collar |
| Additionally, in FIGS. 5 through 8 | |
| 21 | Common contact body |
| 21a | Connector contact |
| 22 | First selective contact body |
| 22a | Connector contact |
| 22b | Contact surface |
| 22c | Leading angle |
| 23 | Second selective contact body |
| 23a | Connector contact |
| 23b | Contact surface |
| 23c | Leading angle |
| 24 | Fastening head |
| 25 | Contactor (leaf spring) |
| 25a | Fastening area |
| 25b | Deformation area |
| 25c | Flat actuating area |
| 25d | Transition area |
| 26 | Contact finger |
| 26a | Contact area |
| 26b | Inner apex line |
| 27 | Sliding curvature |
| Additionally in FIGS. 9 through 11: | |
| 31 | Common contact body |
| 31a | Connector contact |
| 31b | Anchoring aperture |
| 32 | First selective contact body |

-continued

| Legend | |
|---|---|
| 32a | Connector contact |
| 32b | Contact surface |
| 33 | Second selective contact body |
| 33a | Connector contact |
| 33b | Contact surface |
| 33c | Anchoring aperture |
| 34 | Fastening projection |
| 35 | Contactor |
| 35a | Fastening area |
| 35b | Deformation area |
| 35c | Actuating area |
| 36 | Fastening slot |
| 37 | Center recess |
| 38 | Reinforcing bead |
| 39 | Longitudinal recess |
| 40 | Contact finger |
| 41 | Engaging end |
| 42 | Mounting base |

The invention claimed is:

1. Electrical switch, comprising:

a common contact body;

a pre-tensioned elastically deformable contactor comprising a leaf spring portion and contact fingers projecting from a plane of the leaf spring, the contactor being electrically conductively connected to the common contact body;

an actuating member for elastically deforming the contactor; and a first selective contact body having contact surfaces and a second selective contact body having contact surfaces;

and wherein at least one first finger of the contactor, under pre-tension of the contactor, is in contact only with the contact surfaces of the first selective contact body and at least one second finger of the contactor is not in contact with the contact surfaces of either the first or the second selective contact body when the actuator is in a first switch position, and the at least one second finger of the contactor is in contact only with the contact surfaces of the second selective contact body and the at least one first finger of the contactor is not in contact with the contact surfaces of either the first or the second selective contact body when the actuator is in a second switch position and the respective contact fingers slidingly engage the respective contact surfaces during movement of the actuator between the switch positions.

2. Electrical switch, comprising:

a common contact body;

a pre-tensioned elastically deformable contactor comprising a leaf spring portion and contact fingers projecting from a plane of the leaf spring, the contactor being electrically conductively connected to the common contact body;

an actuating member for elastically deforming the contactor; and a first selective contact body having contact surfaces and a second selective contact body having contact surfaces; and a switch housing; wherein at least one first finger of the contactor, under pre-tension of the contactor, is in contact only with the contact surfaces of the first selective contact body and at least one second finger of the contactor is not in contact with the contact surfaces of either the first or the second selective contact body when the actuator is in a first switch position, and the at least one second finger of the contactor is in contact only with the contact surfaces of the second selective contact body and the at least one first finger of the contactor is not in contact with the contact surfaces of either the first or the second selective contact body when the actuator is in a second switch position and the respective contact fingers slidingly engage the respective contact surfaces during movement of the actuator between the switch positions;

the leaf spring portion of the contactor is substantially flat and extends in a longitudinal direction of the switch and the contactor also has a step-shape, U-shape or angular-shape portion;

the common contact body and the first and the second selective contact bodies, in that order, are spaced from each other in the longitudinal direction of the switch;

the contactor comprises proximate a first end of the contactor a fastening area, adjacent the fastening area a deformation area formed by a center portion of the step-shape portion, a bottom portion of the U-shape portion or an apex portion of the angular portion, and adjacent the deformation area and proximate a second end of the contactor a rigid actuating area;

the contactor is fastened at the fastening area to the common contact body and to a base of the switch housing and is pre-tensioned so that the actuating area thereof is in contact with the actuating member; and the contact fingers extend from the actuating area.

3. Electric switch according to claim 2, further comprising a compression spring which reinforcingly acts on the pre-tension of the contactor and urges the actuating member toward the unactuated state thereof.

4. Electric switch according to claim 3, wherein the actuating area comprises opposed longitudinal edges integral with and extending substantially normally from a planar main portion of the actuating area thereby to stiffen the actuating area.

5. Electric switch according to claim 4, wherein the contact fingers project from the longitudinal edges.

6. Electric switch according to claim 5, wherein the actuating area has a central opening into which the first and the second selective bodies project and the at least one first contact finger and the at least one second contact finger each comprise a pair of the contact fingers facing each other across the central opening.

7. Electric switch according to claim 6, wherein the first and the second selective contact bodies each have on opposite sides thereof a flat face in a plane parallel to the longitudinal direction of the switch, the contact surfaces being situated on the flat faces.

8. Electric switch according to claim 5, wherein:

the actuating area is bent backward over the deformation area thereby to form the U-shape;

the edges extend longitudinally beyond the actuating area thereby to form the first and the second contact fingers;

the selective contact bodies each have on opposite sides thereof a flat face in a plane parallel to the longitudinal direction of the switch, the contact surfaces being situated on the flat faces; and the selective contact bodies are received between the contact fingers with the flat faces of the selective contact bodies facing the contact fingers.

9. Electric switch according to claim 8, wherein the contact fingers project from a transition area between the actuating area and the fastening area and extend in a direction opposite a free end of the actuating area.

10. Electric switch according to claim 3, wherein the actuating area comprises a longitudinal rib integral with and extending longitudinally along a planar main portion of the actuating area thereby to stiffen the actuating area.

11. Electric switch according to claim 10, wherein:

the fastening area is bent back under the deformation area and toward the actuating area thereby to form the angular-shape portion;

the contact fingers project from the central area laterally spaced from the actuating area on opposite sides of the actuating area and are bent back in a direction away from a free end of the actuating area;

the contact surfaces of the first and the second selective contact bodies extend transversely of the longitudinal direction of the switch for cooperating with the contact fingers;

whereby the contact fingers are always both positioned against the contact surfaces of the first selective contact body or against the contact surfaces of the second selective contact body.

12. Electric switch according to claim 11, wherein each of said selective contact bodies each comprise a plate having flat sides in planes parallel to the lengthwise direction of the switch and end surfaces at 90° from the flat sides, and the contact surfaces are situated on the end surfaces.

13. An electrical switch, comprising:

at least three contact bodies including a common contact body, a first selective contact body having at least one first contact surface and a second selective contact body including at least one second contact surface; and a contactor comprising an electrically conducting material connected in an electrically conducting manner to the common contact body, said contactor including at least one portion which is elastically deformable, said contactor further having a structural configuration which includes at least one first contact region and at least one second contact region that achieve cooperative conductive contact with a respective one of said first and second contact surfaces when said contactor is moved respectively between first and second switch positions by selective deformation of said at least one portion, wherein said at least one first contact region is in contact with the at least one first contact surface and said at least one second contact region not in contact with the at least one second contact surface when in the first switch position, and the at least one second contact region is in contact with the at least one second contact surface and the at least one first contact region is not in contact with the at least one first contact surface when in the second switch position, and the first and second contact regions slidably engage the at least one first contact surface and the at least one second contact surface, respectively, during movement of the contactor between the first and second switch positions.

14. An electrical switch according to claim 13, further comprising an actuating member for elastically deforming the at least one portion of the contactor.

15. An electrical switch according to claim 13, wherein said contactor includes at least a leaf spring portion.

16. An electrical switch according to claim 13, wherein said contactor is pre-tensioned in said first switch position, and is movable to said second position by an applied deformation force to said contactor.

17. An electric switch according to claim 13, further comprising a compression spring which reinforcingly acts on the pre-tension of the contactor and urges the contactor toward the first position.

18. An electrical switch according to claim 13, wherein said at least three contact bodies have different contours from one another.

19. An electrical switch according to claim 13, wherein said at least one first contact region and said at least one second contact region are each comprised of at least one projecting contact finger configured to resiliently electrically contact the at least one first contact surface and the at least one second contact surface when moved to respective ones of said first and second switch positions.

* * * * *